United States Patent [19]

Cornette et al.

[11] Patent Number: 5,036,920

[45] Date of Patent: Aug. 6, 1991

[54] GRAVEL PACK WELL COMPLETION WITH AUGER-SCREEN

[75] Inventors: Holley M. Cornette, Plano; Michael H. Johnson, Spring, both of Tex.; Bennett M. Richard, Lafayette, La.

[73] Assignee: Atlantic Richfield Company, Los Angeles, Calif.

[21] Appl. No.: 518,046

[22] Filed: May 4, 1990

[51] Int. Cl.[5] ..... E21B 43/04

[52] U.S. Cl. ..... 166/278; 166/51; 166/74; 166/205

[58] Field of Search ..... 166/51, 278, 227-231, 166/233, 205, 74

[56] References Cited

U.S. PATENT DOCUMENTS

| | | | |
|---|---|---|---|
| 572,860 | 12/1896 | Brearley | 166/229 |
| 1,080,684 | 12/1913 | Erickson | 166/74 |
| 2,371,391 | 3/1945 | Haynes | 166/51 |
| 2,513,944 | 7/1950 | Kessler | 166/205 |
| 2,879,846 | 3/1959 | Dawson | 166/278 |
| 3,353,599 | 11/1967 | Swift . | |
| 3,362,475 | 1/1968 | Huitt et al. . | |

FOREIGN PATENT DOCUMENTS 151642 10/1981 Fed. Rep. of Germany ..... 166/278

OTHER PUBLICATIONS

Uren, L. C., Petroleum Production Engineering, Oil Field Development, pp. 575-588, McGraw-Hill, New York (1946).

*Primary Examiner*—Ramon S. Britts
*Assistant Examiner*—Roger J. Schoeppel
*Attorney, Agent, or Firm*—Drude Faulconer

[57] ABSTRACT

A method and apparatus for installing a gravel pack completion which does not require the circulation of fluids during installation. The gravel is first placed or preset within the completion zone and then a well completion tool (e.g. a fluid-permeable liner) having an auger blade thereon is lowered and rotated into the present gravel without circulating fluid through the tool. Since the auger blade mechanically displaces the gravel upward as the tool is moved into the preset gravel, there is no need to flow fluid under pressure to "fluidize" the gravel as is required in prior completions of this type.

7 Claims, 2 Drawing Sheets

GRAVEL PACK WELL COMPLETION WITH AUGER-SCREEN

Technical Field

The present invention relates to gravel pack well completions and in one of its preferred aspects relates to a method and apparatus for completing a production or injection well wherein a particulate material (collectively called "gravel") is first positioned or preset within the well adjacent the zone and a fluid-permeable liner having a auger blade thereon is augered into place within said preset gravel to form a gravel pack without circulating fluid through the liner.

Background Art

In completing wells having production or injection zones which lie adjacent incompetent subterranean formations (i.e. formations formed of an unconsolidated matrix such as loose sandstone or the like) or which lie adjacent formations which have been hydraulically-fractured and propped, serious consideration must be given to the sand control problems which will almost certainly arise during the operational life of the well. These problems arise when large volumes of sand and/or other particulate material (e.g. backflow of proppants from a hydraulically-fractured formation) dislodge from the formation and become entrained in the formation fluids and are produced therewith into the wellbore. These produced materials are highly detrimental to the operation of the well and routinely cause erosion, plugging, etc. of the well equipment which , in turn, leads to high maintenance costs and considerable downtime of the well.

While many techniques have been proposed for controlling sand production in a well, probably the most widely-used is one which is generically known as "gravel packing". Basically, a gravel pack completion is one wherein a fluid-permeable liner (e.g. screen, perforated liner, slotted liner, pre-packed screens, combinations thereof, or the like) is positioned within the wellbore (open or cased) adjacent the incompetent or fractured zone and is surrounded by aggregate or particulate material (collectively called "gravel"). As known in the art, the gravel particles are sized to block or filter out the formation particulates which may become entrained in the produced fluids while the openings in the liner are sized to block the gravel from flowing into the liner. This two-stage filtration system is commonly known as a "gravel pack".

There are two basic, well known techniques for installing a typical gravel pack completion in a wellbore. A first of these techniques involves positioning the fluid-permeable liner in the wellbore before placing the gravel around the liner to form the gravel pack. The other technique involves placing the gravel in the wellbore first and then driving, rotating, or washing the liner into the gravel to form the gravel pack. For a good discussion of these techniques, see PETROLEUM PRODUCTION ENGINEERING, Oil Field Development, L. C. Uren, Third Edition, McGraw-Hill Book Co., N.Y., 1946, pps. 575–588.

While both of these techniques have been widely used, both require the circulation of fluid during installation. For example, where the liner is positioned first in the wellbore, a slurry of gravel and a carrier fluid may be pumped down and out through a "cross-over" sub into the annulus formed between the liner and the cased wall (cased hole) or the borewall (open hole). The openings in the liner allows only the carrier fluid to flow from the annulus into the liner while the gravel is strained from the fluid and is deposited within the annulus to form the gravel pack. The gravel can also be placed by flowing the gravel directly into the annulus around the liner from the surface or through open-ended tubulars which extend down the wellbore.

Where the gravel is placed in the wellbore first, the liner is lowered on a workstring and is washed or driven into place while fluid is being pumped down the workstring and out the bottom of the liner. This circulating fluid (i.e. jetting action) is necessary to "fluidize" the pre-positioned or preset gravel so that the liner can be lowered into and through the gravel to form the gravel pack. Unfortunately, since the fluid flows through the workstring, the pumping must be stopped each time an additional stand of workpipe must be added to lower the liner further into the gravel. While the pumping is stopped, the gravel settles and in many instances, cannot be adequately "re-fluidized" upon the resumption of pumping to allow any deeper placement of the liner into the gravel.

Since both techniques require the pumping and/or circulation of fluid under pressure during installation, both may experience severe fluid loss problems, especially when used to complete zones adjacent formations having normal or below normal pressures or pressures which are below the hydrostatic pressure of the completion fluids in the wellbore. For example, in placing gravel around a preset liner, the loss of expensive completion fluids to an underpressured formation (i.e. formation having a pressure less than the fluid pressure in the wellbore) can be excessive. The use of known loss-circulation materials in the gravel slurry is limited since such materials severely hinder the placement of the gravel around the liner. Where the gravel is positioned first, the fluid losses during the high pressure jetting required to "fluidize" the preset gravel also can be excessive. In both cases, these fluid losses not only result in increased costs due to the loss of the expensive completion fluids , themselves, but also contribute to severe formation damage in many cases thereby reducing the productivity and/or operational life of the completed well.

DISCLOSURE OF THE INVENTION

The present invention provides a method and apparatus for installing a gravel pack completion in a zone of a wellbore which does not require the circulation of fluids during installation of the liner. The present invention is especially useful in completing zones which lie adjacent normal or below normal pressured formations. Basically, gravel is first placed within the zone and then a well completion tool having an auger blade thereon is lowered and rotated into the preset gravel without circulating fluid through the tool. Since the auger blade mechanically displaces the gravel upward and outward as the tool is moved into the gravel, there is no need to flow fluid under pressure to "fluidize" the gravel as is required in previous completions of this type.

More particularly, gravel is supplied down the wellbore to preset the gravel in the completion zone. This gravel may be placed by any suitable step, e.g. flowed down a workstring which is positioned in the wellbore, dumped into the wellbore at the surface and allowed to fall by gravity into position, or placed in the wellbore as a result of hydraulically-fracturing and propping the formation). Next, a gravel pack well completion tool assembly comprised of a workstring and an auger-screen is lowered into the wellbore until it contacts the top of the preset gravel. The workstring is then rotated to "auger" the auger-screen into the preset gravel to form the gravel pack without circulating fluid through the auger-screen. In some applications, the workstring will function as the production tubing while in others, the workstring will be removed and replaced with a different string of production tubing.

The auger-screen is comprised of a body which, in turn, is comprised of a fluid-permeable liner having an auger blade secured to and extending along the outer periphery thereof. One embodiment of the present invention includes a safety feature in the event the auger-screen becomes stuck during installation. This feature includes a valve sub which is connected to the lower end of the body and has a check valve therein to prevent upward flow into the body. A tapered plug is connected to the lower end of the valve sub and has at least one fluid outlet passage. A wash pipe is connected to the workstring and extend through the body to fluidly communicate with the outlet passage in the tapered plug so that if the auger-screen should become stuck within the gravel during installation, fluid can be pumped down the workstring/wash pipe and out the outlet passage to "fluidize" the gravel so that the tool can be withdrawn. Once the auger-screen is properly positioned within the gravel to form the gravel pack, the workstring is released and withdrawn and is replaced with production tubing or the like.

The present invention allows a fluid-permeable liner to be augered into preset gravel and placed across perforations (in a cased hole) without pumping fluid to "wash" the liner into place. This will substantially reduce the cost of gravel packed completions, especially in short zone situations, by reducing hardware costs, rig time, and pumping costs normally associated with prior art gravel pack completions. It also will result in additional savings and in reduced formation damage in underpressured reservoirs.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
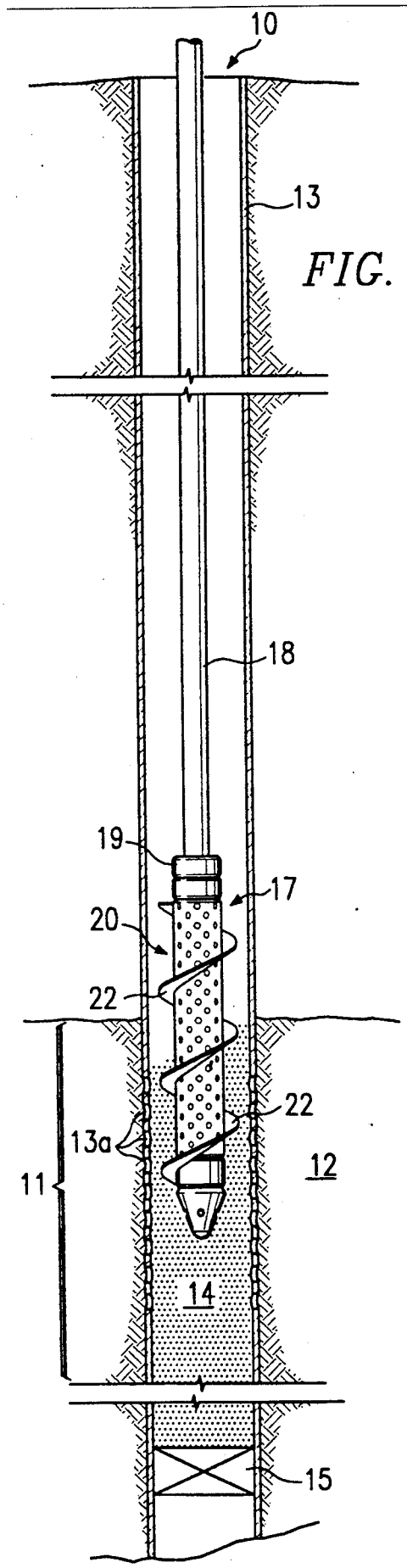
FIG. 1 is an elevational view, partly in section, of a well undergoing a gravel pack completion in accordance with the present invention.

Referring more particularly to the drawings, FIG. 1 illustrates the gravel pack completion of the present invention as it is being installed in well 10 (e.g. production or injection well). Well 10 has a completion zone 11 therein which lies adjacent to a relatively incompetent formation 12 of the type which is likely to produce sand and/or other particulate material with the formation fluids, e.g. hydrocarbons, at some time during its operational life. As shown, well 10 has been cased along its length with casing 13 which has been perforated to provide perforations **13*a* adjacent zone 11**. While the present invention is shown and described in relation to completing a zone in a cased, vertical wellbore, it should be understood that the invention can also be used for carrying out completions in open holes as well as in horizontal or deviated wells or to prevent proppant flowback in wells which have been hydraulically-fractured and propped.

In installing the present gravel pack completion in wells where the wellbore extends past the bottom of completion zone 11, a cement plug, bridge plug or an equivalent-type packer 15 is set in the wellbore at the lower end of zone 11. Sufficient gravel is then supplied down the wellbore and onto the top of plug 15 to fill the area of the wellbore which extends through the length of zone 11 to be completed with preset gravel 14. "Gravel" as used herein is intended to include all particulate and/or aggregate materials (e.g. gravel, sand, combinations, etc.) which are used or can be used in gravel pack or fractured completions. As known in the art, the "gravel" particles used in a particular situation are sized so as to block or filter out the particulates which may be produced with the well fluids or which are used to prop open hydraulically induced fractures in the formation.

Figure 2:
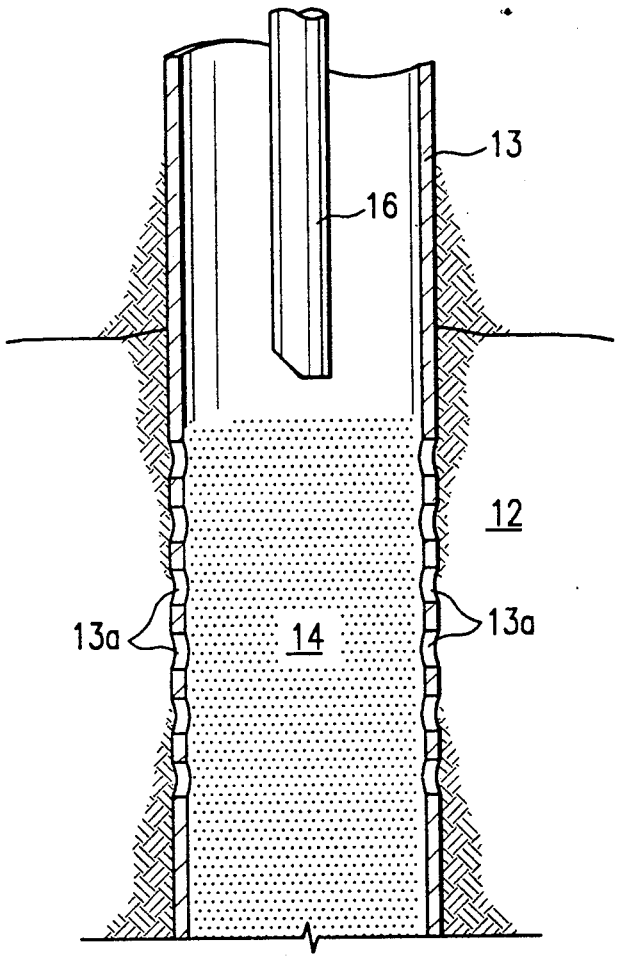
FIG. 2 is a sectional view of a portion of the well of FIG. 1 which lies adjacent the completion zone with only the preset gravel in place in the wellbore.

The preset gravel 14 may be introduced into wellbore in any suitable manner, depending upon the actual circumstances involved with a particular completion zone 11. For example, where formation 12 is a relatively low pressured formation, gravel may be flowed down and out of the lower end of a workstring 16 which is lowered down the well (FIG. 2) and positioned above plug 15 or it may be dumped into the well at the surface and allowed to fall under the influence of gravity. The gravel may be flowed into the wellbore as a substantially dry mixture or as a slurry (mixed with a carrier fluid such as polymer-type, water-based fluid, crude oil, etc.). This type of gravel placement does not require high pressures thereby reducing fluid losses and/or potential damage to the formation. Further, if the situation and formation pressures allow, the gravel may be placed by standard squeeze operations which will insure good filling of perforations **13*a* with the gravel during the placement of the preset gravel 14**.

After the preset gravel 14 is in place adjacent to zone 11, gravel pack well tool 17 is lowered into the wellbore. As illustrated, gravel pack well tool 17 is comprised of an auger-screen 20 which is connected onto the bottom of workstring 18 by means of release sub 19. If workstring 18 is to be used as the production tubing, release sub 19 can be replaced with a standard connection.

In accordance with the present invention, auger-screen 20 is comprised of a body 21 having an auger blade 22 welded or otherwise secured to and extending along the outer periphery thereof. Body 21 is comprised of a "fluid-permeable liner", which as used herein is meant to be generic and to include any and all types of liners (e.g. screens, slotted pipes, screened pipes, perforated liners, pre-packed screens and/or liners, combinations of same, etc.) which are used or could be used in well completions of this general type. As will be recognized by those skilled in the art, there are presently several known suppliers from whom such "liners" are readily commercially available. The liner may be of a continuous length, as shown, or it may be comprised of a plurality of segments connected by subs or "blanks".

Figure 4:
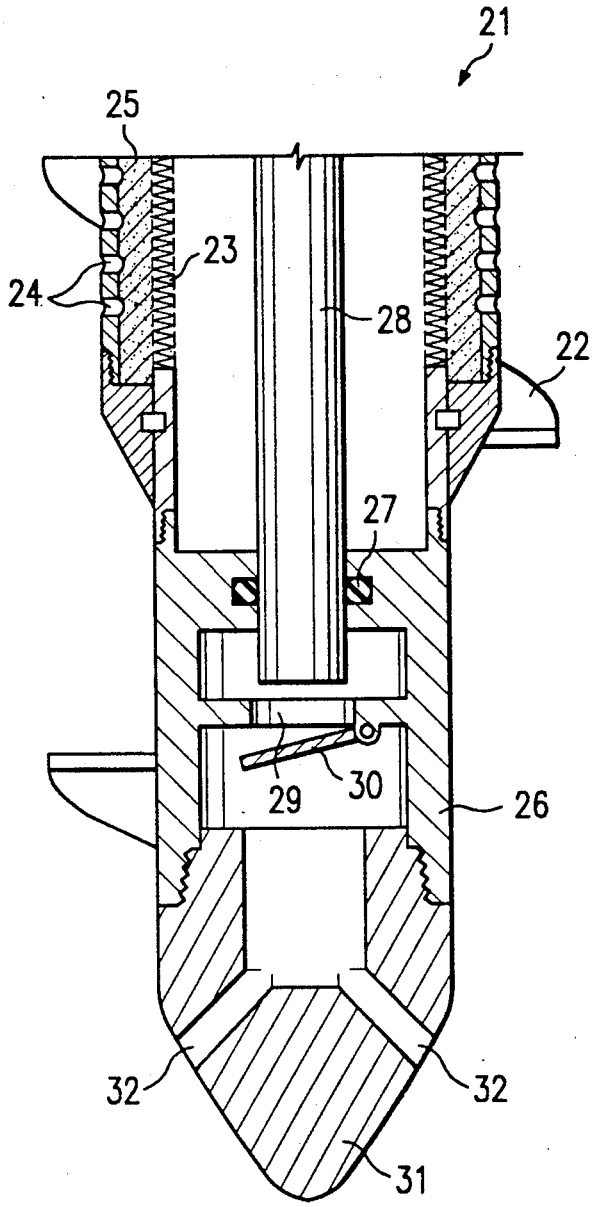
FIG. 4 is a sectional view of the lower end of the auger-liner of FIG. 3.

Body 21, as illustrated in the drawings, is a typical fluid-permeable liner of the type known as a "perforated, pre-packed screen" and is comprised of an inner screen section 23 (FIG. 4) having an outer perforated pipe section 24 mounted thereon to form an annulus 25 therebetween. Annulus 25 is filled with a pre-packed particulate material, e.g. re-sieved Ottawa sand. A valve sub 26 is connected to the lower end of body 21 and has an 0-ring seat 27 adapted to receive the lower end of wash pipe 28 which, in turn, extends through auger screen 20 and is in fluid communication with workstring 18 (FIG. 1). Valve sub 26 also includes a passage 29 which is closed to upward flow by check valve (flapper valve 30). Other types of check valves (e.g. ball valves, rupture disks, etc.) can be used in place of flapper 30 to allow downward flow through passage 29 while preventing upward flow. Tapered nose plug 31 having fluid outlet passages 32 therein is connected to the lower end of sub 26.

Auger blade 22 has basically the same configuration as known earth augers in that it is a continuous flighting which extends helically around the periphery of body 21 and is secured thereto by any appropriate means, e.g. welding. The blade extends sufficiently along the length of auger-screen 20 to insure that the auger-screen 20 will be properly positioned within the preset gravel 14 to form the desired gravel pack completion. If auger screen 20 is comprised of segments and blanks or if blank tubular sections above auger-screen 20 are also to be positioned within gravel 14, auger blade 22 may also extend about the periphery of such blanks.

Again, as shown in FIG. 1, preset gravel 14 is placed adjacent completion zone 11 as described above. Well tool 17 is lowered on workstring 18 until it contacts the top of preset gravel 14. Workstring 18 is then rotated at the surface by a rotary table, power sub, or the like (none shown) to rotate auger-screen 20 and "auger" it downward into preset gravel 14. Since the gravel being displaced by the auger-screen 20 as it moves downward is mechanically moved upward and outward along rotating auger blade 22, there is no need to "fluidized" the preset gravel 14 by circulating fluid as was necessary in previous gravel pack completions of this type. This is extremely important, especially where the completion zone is adjacent a normal or underpressured formation in order to prevent substantial fluid losses and/or severe formation damage during installation of the gravel pack. Further, as the gravel is moved upward by auger blade 22, some of this gravel is likely to be forced into perforations 13*a* in casing 11 thereby improving the overall efficiency of the gravel pack 14.

Figure 3:
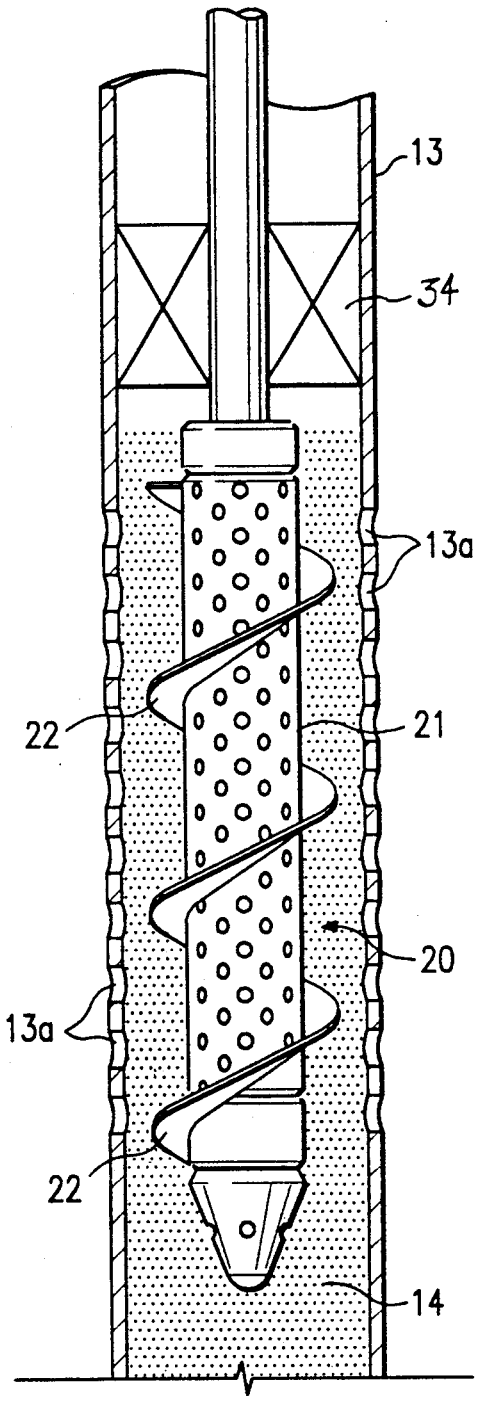
FIG. 3 is a sectional view similar to that of FIG. 2 after the gravel pack completion of the present invention has been completely installed.

If auger-screen 20 becomes stuck in preset gravel 14 before it has reached its desired position, fluid can be flowed down workstring 18, wash pipe 28, and out passages 32 in nose plug 32 to "fluidize" the gravel whereby auger-screen can be lowered the remaining distance in gravel 14 or it can be removed to the surface. When auger-screen 20 is properly positioned within preset gravel 14 to form the gravel pack, sub 19 is released and workstring and wash pipe 28 are withdrawn from the wellbore and are replaced with production tubing or the like and packer 34 (FIG. 3) to finish the well completion as will be understood by those skilled in the art.

What is claimed is:

1. An auger-screen for gravel-pack well completions comprising:

a body comprising a fluid-permeable liner;

an auger blade secured to and extending along said body;

a valve sub having one end connected to one end of said body, said sub having a fluid passage therethrough; and means for allowing flow only in one direction through said passage from said body through said sub.

2. The auger-screen of claim 1 wherein said valve sub includes:

a seat adapted to receive the lower end of a wash pipe.

3. The auger-screen of claim 1 including:

a tapered plug connected to the other end of said valve sub, said plug having at least one fluid outlet passage therethrough in communication with said passage in said valve sub.

4. A gravel pack well tool assembly comprising:

a workstring;

an auger-screen connected at one end to said workstring, said auger-screen comprising:

a body comprising a fluid-permeable liner;

an auger blade secured to and extending along the outer periphery of said body;

a valve sub connected to the other end of said body, said sub having a fluid passage therethrough, and a check valve for allowing flow in only one direction through said passage from said workstring through said sub.

5. The well tool assembly of claim 4 including:

a seat in said valve sub above said passage; and a wash pipe connected to and in fluid communication with said workstring, said wash pipe extending through said body with the lower end of said wash pipe being received by said set in said valve seat to establish fluid communication between said workstring and said passage.

6. The well tool assembly of claim 5 including:

a tapered plug connected to the other end of said valve sub, said plug having at least one fluid outlet passage therethrough in communication with said passage in said valve sub.

7. A gravel pack well tool assembly comprising:

a workstring having at least one blank tubular section at its lower end;

an auger-screen connected at one end to said blank tubular section of said workstring; said auger-screen comprising:

a body comprising a fluid-permeable liner;

an auger blade secured to and extending along both the outer periphery of said body and said at least one blank tubular section of said workstring.

* * * * *